US012391507B2

(12) United States Patent
Tateishi et al.

(10) Patent No.: US 12,391,507 B2
(45) Date of Patent: Aug. 19, 2025

(54) IMAGE FORMING APPARATUS

(71) Applicant: CANON KABUSHIKI KAISHA, Tokyo (JP)

(72) Inventors: Tomoya Tateishi, Kanagawa (JP); Yasuhiro Fukase, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 235 days.

(21) Appl. No.: 18/060,730

(22) Filed: Dec. 1, 2022

(65) Prior Publication Data

US 2023/0174335 A1 Jun. 8, 2023

(30) Foreign Application Priority Data

Dec. 7, 2021 (JP) ..... 2021-198283

(51) Int. Cl.

| | |
|---|---|
| ***B65H 29/22*** | (2006.01) |
| ***B65H 29/48*** | (2006.01) |
| ***B65H 31/22*** | (2006.01) |
| ***B65H 43/02*** | (2006.01) |

(52) U.S. Cl.

CPC ..... *B65H 29/22* (2013.01); *B65H 29/48* (2013.01); *B65H 31/22* (2013.01); *B65H 43/02* (2013.01); *B65H 2402/442* (2013.01); *B65H 2801/12* (2013.01)

(58) Field of Classification Search

CPC ..... B65H 2405/15; B65H 2405/115; B65H 2405/1124

See application file for complete search history.

(56) References Cited

U.S. PATENT DOCUMENTS 7,553,099 B2 * 6/2009 Bandou ..... B41J 29/13 400/624

2006/0263127 A1 * 11/2006 Kim ..... G03G 15/6502 399/393

FOREIGN PATENT DOCUMENTS

JP 2021151715 A 9/2021

* cited by examiner

*Primary Examiner* — Howard J Sanders

(74) *Attorney, Agent, or Firm* — Canon U.S.A., Inc. IP Division

(57) ABSTRACT

An image forming apparatus includes a stacking tray on which a sheet is stacked, a cover unit, and an apparatus main body having an image forming unit. The cover unit forms a sheet storage portion storing the sheet between the cover unit and the stacking tray, and covering the sheet stacked on the stacking tray. The cover unit includes a first cover portion attached to a second cover portion that rotates about a rotating shaft at a position on a sheet rear end side in a sheet conveying direction to open and close an opening that leads to the sheet storage portion. An exterior surface of the second cover portion faces outside the sheet storage portion when the second cover portion is closed to close the opening and faces up in a vertical direction when the second cover portion is in an open state where the opening is open.

17 Claims, 6 Drawing Sheets

IMAGE FORMING APPARATUS

BACKGROUND

Field

The present disclosure relates to an image forming apparatus configured to form an image on a sheet.

Description of the Related Art

Conventionally, examples of an image forming apparatus include electrophotographic printers such as an electrophotographic copying machine, a light-emitting diode (LED) printer, and a laser beam printer, an electrophotographic facsimile apparatus, and an electrophotographic word processor.

Some of such image forming apparatuses are configured in such a way that the size of an apparatus main body is so small that a part of a stacking tray on which a sheet is stacked and a part of the sheet stacked on the stacking tray protrude from the apparatus main body. In an image forming apparatus configured in such a way that the sheet is stacked protruding from the apparatus main body, dust near the apparatus main body may be attached to the protruding sheet. If printing is performed in the state where the dust is attached to the sheet, the following arises. The dust is attached to a conveying roller, thereby causing a conveyance failure. The dust enters an image forming unit, thereby causing an image defect.

For the purpose of preventing such a conveyance failure and an image defect, for example, there is a method for installing a sheet feeding tray cover that covers a sheet (hereinafter also referred to as a "dust cover") as discussed in the publication of Japanese Patent Application Laid-Open No. 2021-151715. Even in an image forming apparatus configured in such a way that a part of the sheet protrudes from the apparatus main body, this method can prevent dust from being attached to the sheet.

In a case where the dust cover covers the entirety of a sheet of a large size (a legal size) larger than a sheet of a normal size (a letter size or an A4 size) frequently used by a user, the installation area of the main body increases. An opening portion is provided on the sheet rear end side of the dust cover, and only in a case where the sheet of the large size is stacked, the sheet is caused to protrude from the dust cover, thereby preventing an increase in the installation area of the main body. However, also in a case where the sheet of the normal size is used, dust enters through the opening portion. This decreases the effect of preventing dust from being attached to the sheet.

SUMMARY

According to an aspect of the present disclosure, an image forming apparatus includes an apparatus main body including an image forming unit configured to form an image on a sheet that is conveyed, a stacking tray on which the sheet is to be stacked, wherein the stacking tray protrudes from the apparatus main body, and a cover unit forming a sheet storage portion configured to store the sheet between the cover unit and the stacking tray, and covering the sheet stacked on the stacking tray, wherein the cover unit includes a first cover portion and a second cover portion attached to the first cover portion to be rotationally movable about a rotating shaft at a position on a rear end side of the sheet in a conveying direction of the sheet stacked on the stacking tray and configured to open and close an opening that leads to the sheet storage portion, wherein the second cover portion is attached to the first cover portion so that an exterior surface of the second cover portion facing outside of the sheet storage portion when the second cover portion is in a closed state where the opening is closed and faces up in a vertical direction in a case where the second cover portion is in an open state where the opening is open.

Further features of the present disclosure will become apparent from the following description of exemplary embodiments with reference to the attached drawings.

DESCRIPTION OF THE EMBODIMENTS

With reference to FIGS. 1 to 6C, an image forming apparatus according to a first exemplary embodiment of the present disclosure is described.

Figure 1:
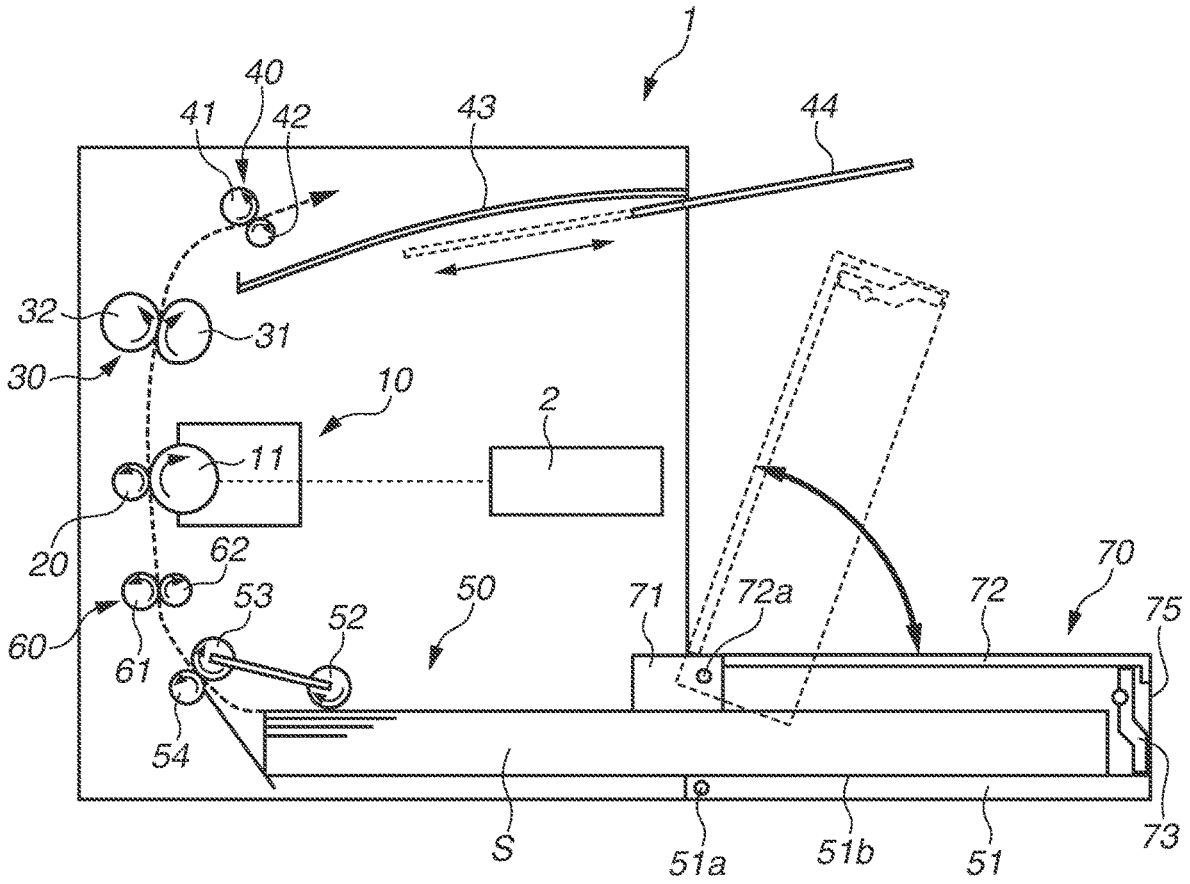
FIG. 1 is a cross-sectional view illustrating an overall configuration of an image forming apparatus.

FIG. 1 illustrates a printer 1 as the image forming apparatus according to the present exemplary embodiment. The configuration and the function of the printer 1 are to be described below. In the following description, an up-down direction is defined such that in the vertical direction, an upward direction is an up direction and a downward direction is a down direction. A front-back direction is defined such that the front side of the printer 1 (the right side in FIG. 1) is a front direction and the back side of the printer 1 (the left side in FIG. 1) is a back direction. The description is given by defining a left-right direction such that in the state where the printer 1 is viewed from the front side to the back side of the printer 1, the left side of the printer 1 is a left direction and the right side of the printer 1 is a right direction.

A process cartridge 10 is placed in an apparatus main body of the printer 1. The process cartridge 10 according to the present exemplary embodiment is obtained by integrally assembling a photosensitive drum 11 as an image bearing member and a developing roller (not illustrated) as a process unit that acts on the photosensitive drum 11 into the process cartridge 10.

A laser unit 2 is placed in a front portion of the process cartridge 10. The laser unit 2 scans and exposes the surface of the photosensitive drum 11 of the process cartridge 10 with laser light, thereby sequentially forming electrostatic latent images. Next, the developing roller develops the electrostatic latent images, thereby forming a toner image. A transfer roller 20 is brought into contact with the photosensitive drum 11. A fixing device 30 and a sheet discharge roller pair 40 are placed in an upper portion of the apparatus main body. A sheet discharge tray 43 is placed on an upper surface of the apparatus main body. The fixing device 30 includes a fixing film 31 and a pressure roller 32. The sheet discharge roller pair 40 includes a sheet discharge roller 41 and a sheet discharge rotatable member 42.

When an image is formed, a sheet S stacked on a stacking tray 51 of a sheet storage device 50 including the stacking tray 51 and a cover unit 70 as a dust cover is fed by a pickup roller 52 that rotates clockwise in FIG. 1. In a case where sheets S are multi-fed, the sheets S are separated by a feed roller 53 and a separation roller 54. A skew correction unit (not illustrated) corrects the skew of the sheet S in a nip portion between a conveying roller 61 and a conveying roller 62 as a conveying roller pair 60.

The sheet S is conveyed to a nip portion between the photosensitive drum 11 as an image forming unit and the transfer roller 20, and the toner image formed on the photosensitive drum 11 is transferred to the sheet S. Further, the sheet S to which the toner image is transferred is conveyed to a nip portion between the fixing film 31 and the pressure roller 32 and heated and pressurized, so that the toner image is fixed to the sheet S. The sheet S to which the toner image is fixed is discharged to the sheet discharge tray 43 by the sheet discharge roller 41 and the sheet discharge rotatable member 42. It is possible to prevent the discharged sheet S from falling by pulling out a sheet discharge extension tray 44 that can be accommodated in the apparatus main body.

The stacking tray 51 is attached as a part of the apparatus main body to the image forming apparatus so that the apparatus is downsized, and the stacking tray 51 therefore protrudes from the apparatus main body. In the protruding portion, the cover unit 70 detachably attached to the apparatus main body covers the stacking tray 51 and an upper surface and side surfaces of the sheet S stacked on the stacking tray 51. In the present exemplary embodiment, a configuration is employed in which only the cover unit 70 is attachable to and detachable from the apparatus main body. Alternatively, a stacking tray and a cover unit may be configured as a cassette attachable to and detachable from the apparatus main body.

The cover unit 70 forms a sheet storage portion 74 as a space for storing the sheet S between the stacking tray 51 and the cover unit 70. Because the sheet S stacked on the stacking tray 51 is covered by the cover unit 70, the cover unit 70 can prevent dust from being attached to the sheet S.

The cover unit 70 includes a cover fixing member 71 having an attachment portion (described below, but not illustrated in FIG. 1) to which the cover unit 70 is attached. The cover unit 70 includes a main cover 72 as a first cover portion that covers the upper surface and the left and right side surfaces of the sheet S. A side surface of the main cover 72 on the upstream side in the conveying direction of the sheet S is an opening 75 that leads to the sheet storage portion 74. An opening/closing portion 73 as a second cover portion is attached to the main cover 72 in such a way that the opening/closing portion 73 is rotationally movable about a rotating shaft 73*c* at a position on the rear end side of the sheet S in the conveying direction of the sheet S. The opening/closing portion 73 opens and closes the opening 75.

The main cover 72 is configured to be openable and closable about a main cover fulcrum 72*a* as indicated by an arrow in FIG. 1. In the state where the main cover 72 is open, a user can set the sheet S on the stacking tray 51. The main cover fulcrum 72*a* is located above a sheet stacking surface 51*b* of the stacking tray 51 in the vertical direction. The stacking tray 51 can rotationally move counterclockwise in FIG. 1 about a tray fulcrum 51*a* in the state where the cover unit 70 is detached.

<Specific Configuration of Cover Unit 70>

Figure 2A:
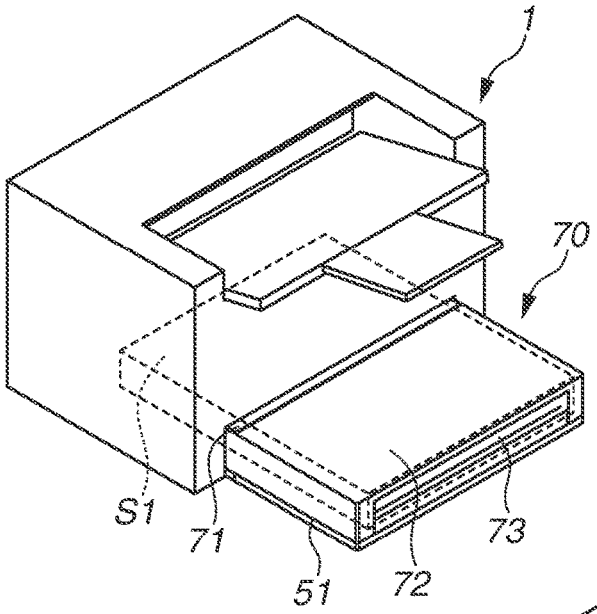
FIGS. 2A to 2C are perspective views illustrating a vicinity of an apparatus main body and a cover unit.
Figure 2B:
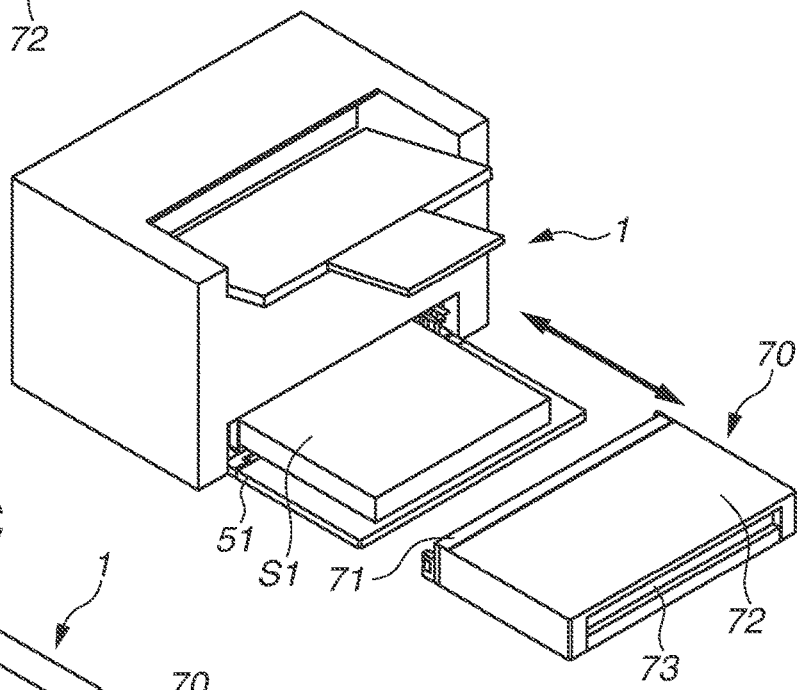
Figure 2C:
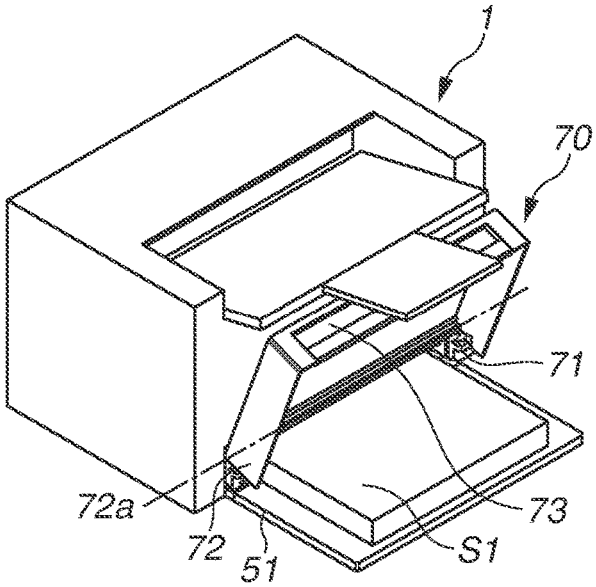

With reference to FIGS. 2A to 2C, the specific configuration of the cover unit 70 according to the present exemplary embodiment is to be described. FIGS. 2A to 2C are perspective views illustrating the apparatus main body and the cover unit 70 according to the present exemplary embodiment.

FIG. 2A illustrates the state where a sheet S1 of a normal size (an A4 size in the present exemplary embodiment) generally frequently used by the user is stacked on the stacking tray 51, and the cover unit 70 is attached. In this state, the sheet S1 is covered by the main cover 72 and the opening/closing portion 73. The size of a sheet in the present exemplary embodiment indicates the size of the sheet in the direction in which the sheet is conveyed from the stacking tray 51 in the horizontal direction, i.e., in the front-back direction of the image forming apparatus.

FIG. 2B illustrates the state where the cover unit 70 is detached from the apparatus main body. If the cover unit 70 can be detached, there are advantages that it is easy to clear a jam and that the package size for transportation can be small. FIG. 2C illustrates the state where the cover unit 70 is opened by rotating the cover unit 70 about the main cover fulcrum 72*a*. In the present exemplary embodiment, such a state is maintained, so that the user can easily stack the sheet S1.

Figure 3A:
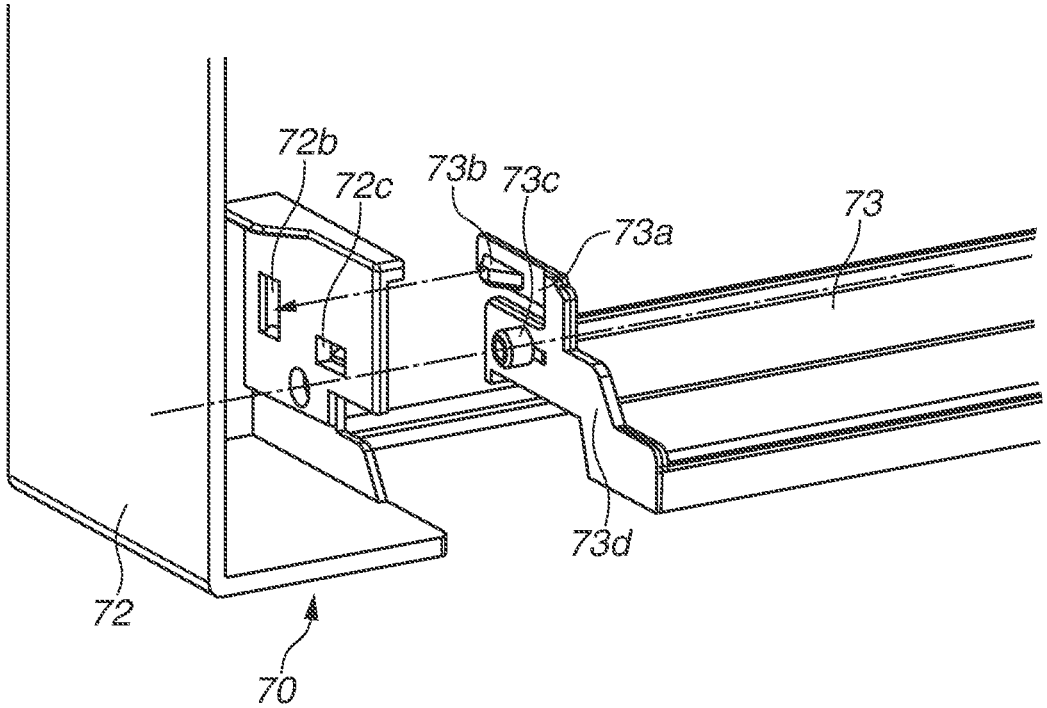
FIGS. 3A and 3B are perspective views illustrating an opening/closing mechanism of an opening/closing portion.

With reference to FIGS. 3A to 6C, the configuration of the opening/closing portion 73 is specifically to be described. FIGS. 3A and 3B are perspective views illustrating an opening/closing mechanism of the opening/closing portion 73. FIG. 3A is a perspective view in a case where the opening/closing portion 73 is in a closed state. The opening/closing portion 73 includes a base portion 73*d*, an arm portion 73*a* extending from the base portion 73*d* and capable of elastically deforming, and a projection portion 73*b* as an engagement portion located on the end side of the arm portion 73*a*.

In the closed state of the opening/closing portion 73, the projection portion 73*b* is engaged with a hole portion 72*b* as a second engagement target portion of the main cover 72 and maintains the closed state.

Figure 3B:
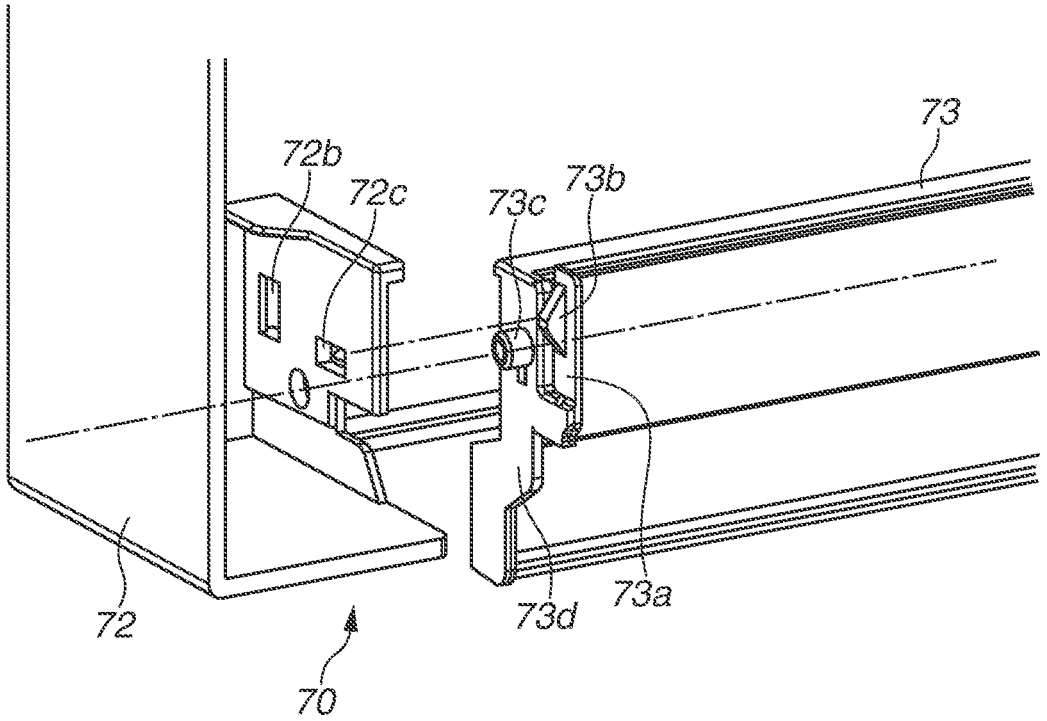

FIG. 3B is a perspective view in a case where the opening/closing portion 73 is in an open state. In a case where the user rotates the opening/closing portion 73 about the rotating shaft 73*c*, the projection portion 73*b* is engaged with a hole portion 72*c* as a first engagement target portion of the main cover 72 so that the open state can be maintained. Although FIGS. 3A and 3B illustrate only the right side of the cover unit 70, the left side also has a similar shape.

Although the projection portion 73*b* is provided in the opening/closing portion 73 and the hole portions 72*b* and 72*c* are provided in the main cover 72 in the present exemplary embodiment, the projection portion and the hole portions may be placed the other way around so long as the opening/closing portion 73 and the main cover 72 are configured to be engaged with each other.

Figure 4A:
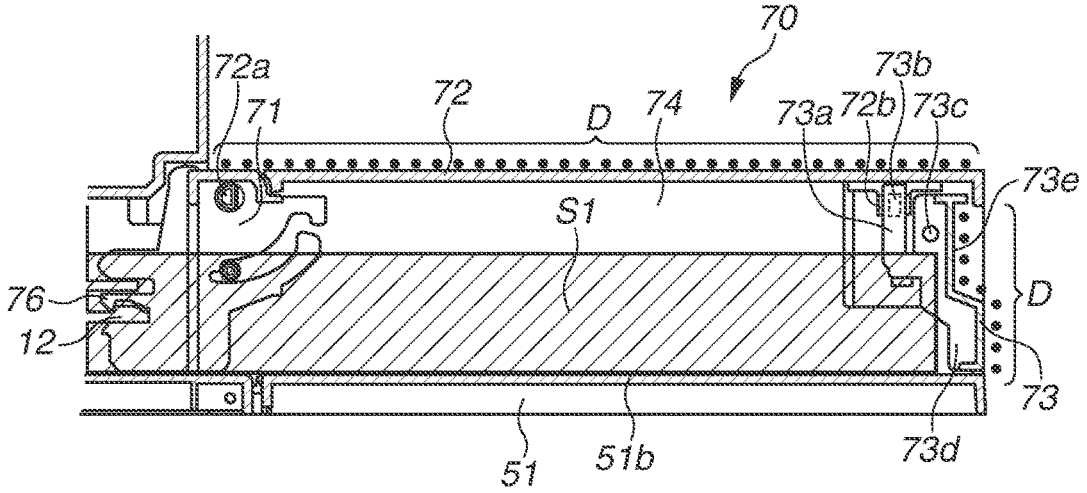
FIGS. 4A to 4C are cross-sectional views illustrating a vicinity of a stacking tray and the cover unit.
Figure 4B:
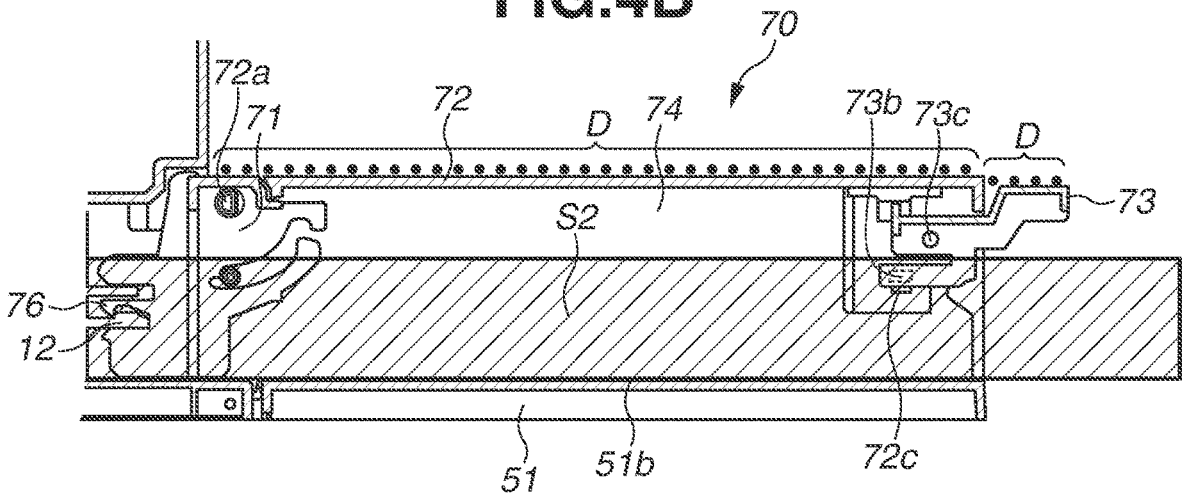
Figure 4C:
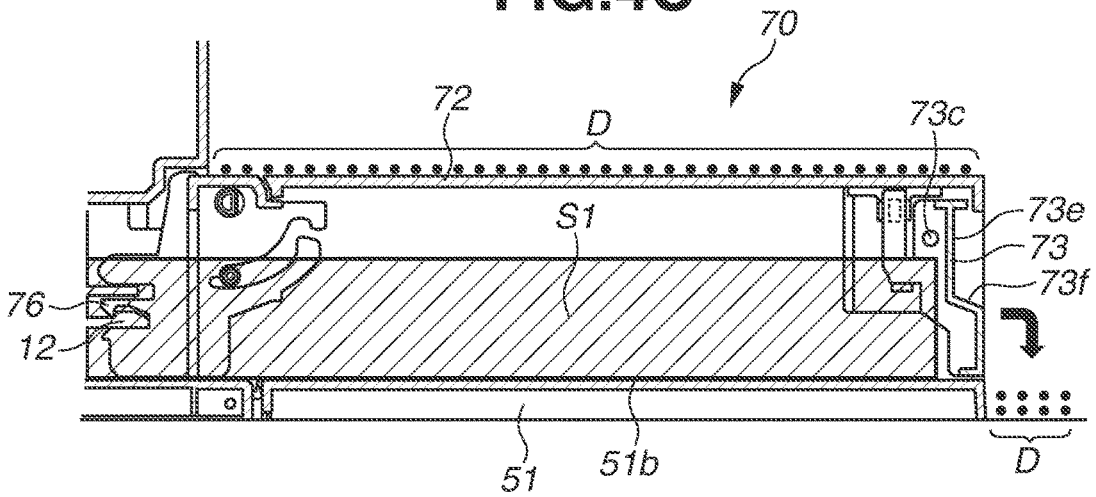

FIGS. 4A to 4C are cross-sectional views illustrating the vicinity of the stacking tray 51 and the cover unit 70. FIG. 4A is a cross-sectional view in a case where the opening/closing portion 73 is in the closed state. FIG. 4B is a cross-sectional view in a case where the opening/closing portion 73 is in the open state. FIG. 4C is a cross-sectional view in a case where the opening/closing portion 73 moves from the open state to the closed state. The cover unit 70 includes an attachment portion 76. The attachment portion 76 elastically deforms, thereby becoming attachable to and detachable from an attachment target portion 12 of the apparatus main body.

As illustrated in FIG. 4A, the stacking tray 51 according to the present exemplary embodiment can also cover a front surface of a sheet of a size smaller than or equal to the sheet S1 (A4) (the rear end side of the sheet S in the conveying direction of the sheet S) by bringing the opening/closing portion 73 into the closed state. In this state, the main cover 72 prevents dust D from being attached to an upper surface and left and right side surfaces of the sheet S1, and the opening/closing portion 73 prevents the dust D from being attached to a front surface of the sheet S1. A surface forming the outside of the opening/closing portion 73 and preventing the dust D from the front surface, specifically, a surface facing the opposite side (the outside) of the sheet storage portion 74 in a case where the opening/closing portion 73 is in the closed state, is referred to as an "exterior surface 73*e*".

FIG. 4B is a diagram illustrating the state where a sheet S2 of a large size (a legal size in the present exemplary embodiment) is stacked. In the sheet storage device 50, the sheet S2 can be stacked on the stacking tray 51 by bringing the opening/closing portion 73 into the open state. That is, the openable and closable opening/closing portion 73 makes it possible to stack the sheet S2 of the large size without increasing the installation area of the main body and also prevent the dust D from being attached to the sheet S1 of the normal size that is frequently used.

In the present exemplary embodiment, the rotating shaft 73*c* is placed above the sheet stacking surface 51*b* of the stacking tray 51. The exterior surface 73*e* faces up in the vertical direction in a case where the opening/closing portion 73 is in the open state. Thus, in this configuration, even in the state where the dust D is attached to the opening/closing portion 73 as illustrated in FIGS. 4A and 4B, the dust D is less likely to enter the inside of the sheet storage portion 74 as illustrated in FIG. 4C by opening and closing the opening/closing portion 73.

Figure 5A:
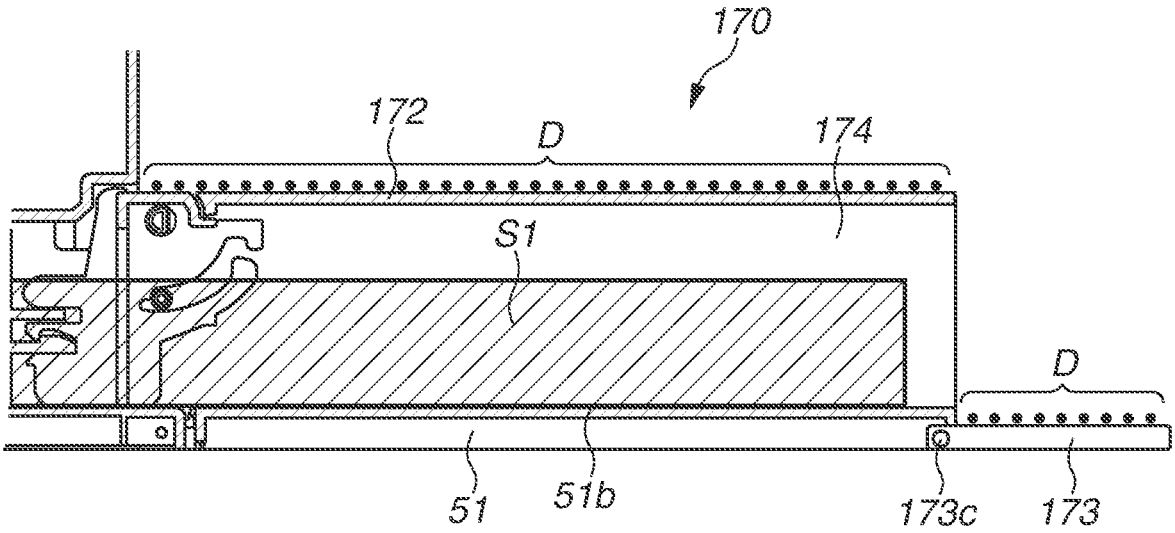
FIGS. 5A and 5B are cross-sectional views illustrating a comparative example different from the present disclosure.
Figure 5B:
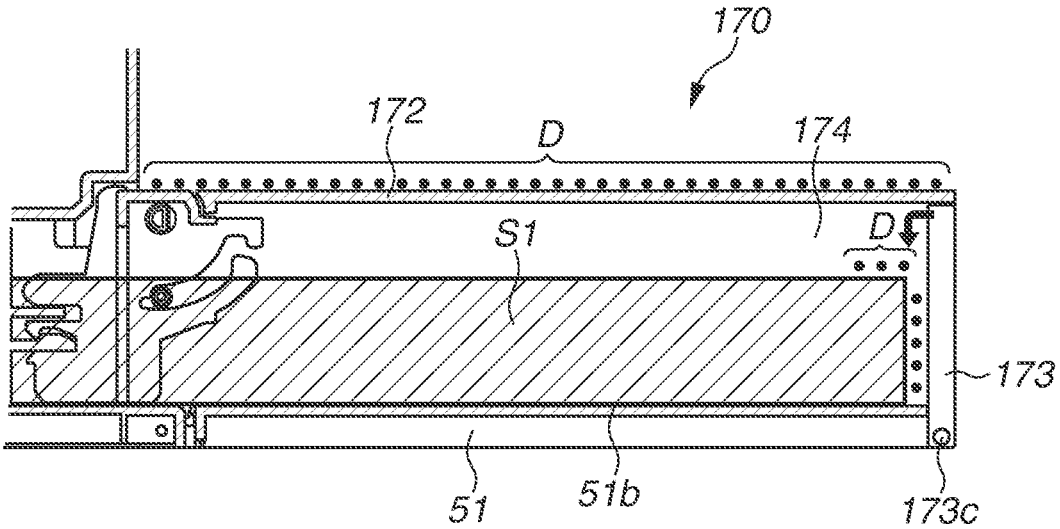

FIGS. 5A and 5B illustrate a configuration in which a rotating shaft 173*c* is placed in a lower portion as a comparative example different from the present disclosure. The comparative example discloses a cover unit 170 including a main cover 172 and an opening/closing portion 173. FIG. 5A is a cross-sectional view of the state where the opening/closing portion 173 is open. FIG. 5B is a cross-sectional view in a case where the opening/closing portion 173 is shifted from the open state to a closed state.

As illustrated in FIG. 5A, in a case where the user maintains the open state of the opening/closing portion 173, the dust D is attached to an upper surface (an inner side surface) of the opening/closing portion 173. As illustrated in FIG. 5B, the upper surface of the opening/closing portion 173 in the open state faces the inside of a sheet storage portion 174 in the closed state, and for this reason, the dust D enters the sheet storage portion 174.

Also in a case where the sheet S2 of the large size is used, the area of a covered portion in an upper surface of the sheet S2 is greater in the present exemplary embodiment than that in the example illustrated in FIGS. 5A and 5B. Thus, the dust D is less likely to be accumulated on the sheet S2 in the present exemplary embodiment.

<Inclination of Opening/Closing Portion 73>

Figure 6A:
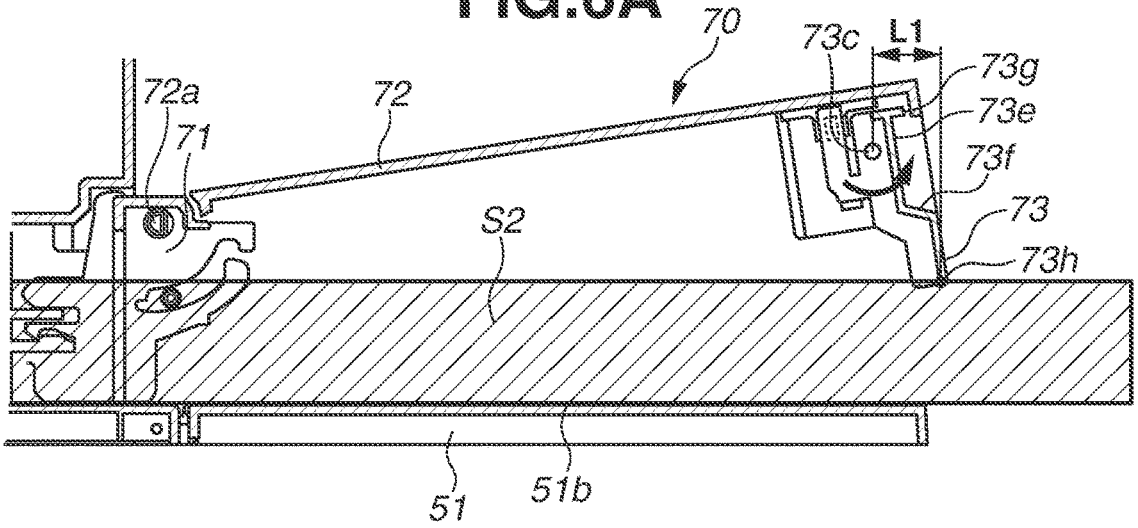
FIGS. 6A to 6C are cross-sectional views illustrating opening and closing movements of the opening/closing portion.
Figure 6B:
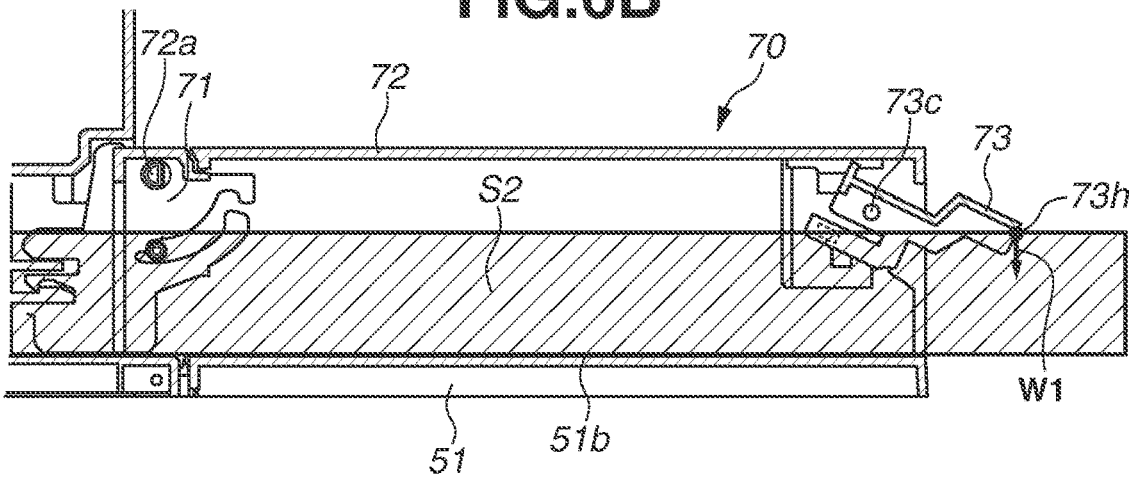
Figure 6C:
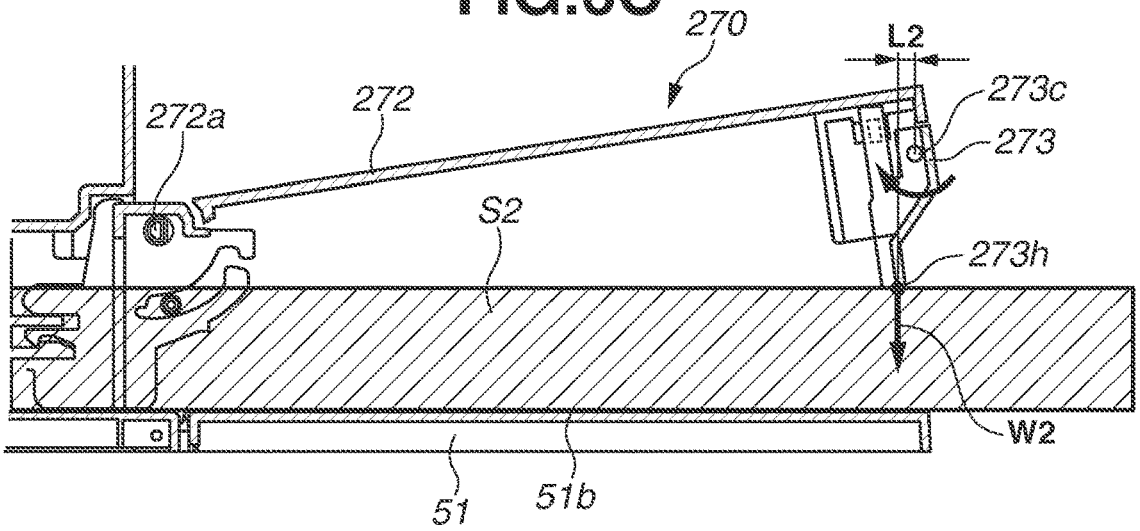

With reference to FIGS. 6A to 6C, the inclination of the opening/closing portion 73 is to be described. FIGS. 6A to 6C are cross-sectional views in a case where the cover unit 70 is closed in the closed state of the opening/closing portion 73. FIG. 6A is a cross-sectional view in a case where an attempt is made to close the main cover 72 in the closed state of the opening/closing portion 73. FIG. 6B is a cross-sectional view in a case where the main cover 72 is closed, being shifted from the state illustrated in FIG. 6A.

As illustrated in FIG. 6A, an inclined portion 73*f* is provided in the opening/closing portion 73. The inclined portion 73*f* is a surface inclined with respect to a direction perpendicular to the axial direction of the rotating shaft 73*c* and the vertical direction in a case where the opening/closing portion 73 is in the closed state. The inclined portion 73*f* is inclined such that the inclined portion 73*f* is further away from the image forming unit in the horizontal direction as the inclined portion 73*f* is further down in the vertical direction. The inclined portion 73*f* is located between an uppermost portion 73*g* and a lowermost portion 73*h* of the opening/closing portion 73.

The inclined portion 73*f* is provided so that a position of the rotating shaft 73*c* is closer to the image forming unit than a position of the lowermost portion 73*h* of the opening/closing portion 73 is in the direction (the front-back direction) perpendicular to the axial direction of the rotating shaft 73*c* and the vertical direction. Furthermore, the position of the rotating shaft 73*c* is closer to the main cover fulcrum 72*a* than the position of the lowermost portion 73*h* of the opening/closing portion 73 is in the direction (the front-back direction) perpendicular to the axial direction of the rotating shaft 73*c* and the vertical direction.

In a case where the main cover 72 is moved in a direction in which the main cover 72 is shifted from the open state to the closed state while the opening/closing portion 73 remains in the closed state in the state where the sheet S2 is stacked, the lowermost portion 73*h* comes into contact with the upper surface of the sheet S2. At this time, in the present exemplary embodiment, the rotating shaft 73*c* is placed at a position closer to the image forming unit by a distance L1 than the lowermost portion 73*h* is in the horizontal direction. Thus, the opening/closing portion 73 receives a force to rotate the opening/closing portion 73 counterclockwise about the rotating shaft 73*c* as indicated by an arrow in FIG. 6A.

As illustrated in FIG. 6B, in a case where the main cover 72 is shifted to the closed state, the opening/closing portion 73 is placed on the sheet S2, and conveyance resistance corresponding to a self-weight W1 of the opening/closing portion 73 is generated. However, the volume of the opening/closing portion 73 is small, and for this reason, the self-weight W1 is small, and the influence of the conveyance resistance is small. A configuration is employed in which the projection portion 73*b* and the hole portion 72*b* are engaged with each other in the closed state of the opening/closing portion 73, but if a force greater than or equal to a certain force is applied in the direction in which the opening/closing portion 73 opens, the engagement is released.

In the present exemplary embodiment, in a case where the opening/closing portion 73 is in the closed state, the uppermost portion 73*g* is located at a position further away from the image forming unit than the rotating shaft 73*c* is. Thus, the opening/closing portion 73 automatically opens without the inclined portion 73*f* as illustrated in FIG. 6B, but the inclined portion 73*f* makes the distance L1 longer, thereby making it easier for the opening/closing portion 73 to open.

The rotating shaft 73*c* and the uppermost portion 73*g* of the opening/closing portion 73 are positioned inside an end portion of the main cover 72 in the direction perpendicular to the axial direction of the rotating shaft 73*c* and the vertical direction. Thus, there is a gap between the uppermost portion 73*g* and the end portion of the main cover 72, and the user can hook their fingers in the gap when the user opens the cover unit 70 to set the sheet S.

As an example of a configuration different from that of the present exemplary embodiment, FIG. 6C illustrates a configuration in which a lowermost portion 273*h* is placed at a position closer to a main cover fulcrum 272*a* by a distance L2 than a rotating shaft 273*c* is. In this configuration, a front cover 273 receives a force clockwise about the rotating shaft 273*c* as indicated by an arrow in FIG. 6C. Thus, the front cover 273 cannot be opened, and both a main cover 272 and the front cover 273 are placed on the sheet S2. As a result, conveyance resistance increases due to a self-weight W2 of the main cover 272 and the front cover 273, and therefore may cause a conveyance failure. The self-weight W1 according to the present exemplary embodiment is smaller than the self-weight W2, and the conveyance resistance due to the self-weight W1 is also significantly smaller than the conveyance resistance due to the self-weight W2.

As described above, the openable and closable opening/closing portion 73 is attached to the cover unit 70 according to the present exemplary embodiment, and accordingly, the sheet S2 of the large size can be stacked in a case where the opening/closing portion 73 is in the open state. Further, the cover unit 70 can cover the entirety of the sheet S1 of the normal size that is frequently used in a case where the opening/closing portion 73 is in the closed state. That is, it is possible to prevent the dust D from being attached to the sheet S1 of the normal size that is frequently used, without increasing the installation area of the printer.

The opening/closing portion 73 is placed such that the exterior surface 73*e* faces up in the vertical direction in a case where the opening/closing portion 73 is in the open state, whereby the dust D attached to the outer surface of the opening/closing portion 73 is less likely to enter the sheet storage portion 74 through the opening 75 by opening and closing the opening/closing portion 73.

In the present exemplary embodiment, a configuration is employed in which the sheet S protrudes to the front side of the main body in a case where the sheet S is stacked on the stacking tray 51. Alternatively, a configuration may be employed in which the sheet S protrudes to the back side of the main body.

According to the present disclosure, it is possible to provide an image forming apparatus which does not reduce the effect that a cover unit prevents dust even in a case where a sheet of a normal size is used, and in which even a sheet of a large size can be stacked without increasing the installation area of a main body of the image forming apparatus.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-198283, filed Dec. 7, 2021, which is hereby incorporated by reference herein in its entirety.

What is claimed is:

1. An image forming apparatus comprising:

an apparatus main body including an image forming unit configured to form an image on a sheet that is conveyed;

a stacking tray on which the sheet is to be stacked, wherein the stacking tray protrudes from the apparatus main body; and a cover unit forming a sheet storage portion configured to store the sheet between the cover unit and the stacking tray, and covering the sheet stacked on the stacking tray, wherein the cover unit includes a first cover portion configured to cover an upper side of the sheet stacked on the stacking tray and a second cover portion attached to the first cover portion to be rotationally movable about a rotating shaft and configured to open and close an opening that leads to the sheet storage portion, wherein the second cover portion is attached to the first cover portion so that an exterior surface of the second cover portion facing outside of the sheet storage portion when the second cover portion is in a closed state where the opening is closed and faces up in a vertical direction in a case where the second cover portion is in an open state where the opening is open, wherein the first cover portion is rotatable so that the first cover portion moves between an open position in which setting a sheet on the stacking tray is allowed and a closed position.

2. The image forming apparatus according to claim 1, wherein the rotating shaft is located above a sheet stacking surface of the stacking tray in the vertical direction.

3. The image forming apparatus according to claim 1, wherein a position of the rotating shaft is closer to the image forming unit than a position of a lowermost portion of the second cover portion is in a direction perpendicular to an axial direction of the rotating shaft and the vertical direction.

4. The image forming apparatus according to claim 3, wherein the second cover portion includes an inclined portion that is inclined in the direction perpendicular to the axial direction of the rotating shaft and the vertical direction, and the inclined portion is inclined in such a way that the inclined portion is inclined in a direction in which the inclined portion is further away from the image forming unit as the inclined portion is further down in the vertical direction in a case where the second cover portion is in the closed state.

5. The image forming apparatus according to claim 4, wherein the inclined portion is located between an uppermost portion of the second cover portion and the lowermost portion of the second cover portion.

6. The image forming apparatus according to claim 1, wherein in a direction perpendicular to an axial direction of the rotating shaft and the vertical direction, the rotating shaft and an uppermost portion of the second cover portion are positioned inside an end portion of the first cover portion, and there is a gap between the end portion of the first cover portion and the uppermost portion of the second cover portion.

7. The image forming apparatus according to claim 1, wherein the second cover portion includes an engagement portion configured to be engaged with the first cover portion and maintain the second cover portion in the open state, and the first cover portion includes a first engagement target portion configured to be engaged with the engagement portion.

8. The image forming apparatus according to claim 7, wherein the second cover portion includes a base portion and an arm portion extending from the base portion, and the engagement portion is provided in the arm portion.

9. The image forming apparatus according to claim 7, wherein the first cover portion includes a second engagement target portion configured to be engaged with the engagement portion, and wherein the engagement portion and the second engagement target portion are engaged with each other so that the second cover portion is maintained in the closed state.

10. The image forming apparatus according to claim 9, wherein the engagement portion is a projection portion protruding from the second cover portion, and each of the first and second engagement target portions is a hole portion configured to be engaged with the projection portion.

11. The image forming apparatus according to claim 1, wherein the stacking tray is attached to the apparatus main body, and the cover unit is attachable to and detachable from the image forming apparatus.

12. The image forming apparatus according to claim 1, wherein a rotation center of the first cover portion is located above the stacking tray.

13. The image forming apparatus according to claim 12, wherein the rotation center of the first cover portion is located on a downstream side with respect to the rotating shaft in a conveying direction of the sheet stacked on the stacking tray.

14. The image forming apparatus according to claim 1, wherein the first cover portion is movable from the open position to the closed position in a state where the sheet is set on the stacking tray.

15. The image forming apparatus according to claim 1, wherein the first cover portion is closable in a state where the second cover portion is in the open state.

16. The image forming apparatus according to claim 1, wherein the second cover portion includes the rotating shaft, and the rotating shaft engages the first cover portion.

17. The image forming apparatus according to claim 1, wherein the stacking tray is rotatable relative to the main body.

* * * * *